United States Patent [19]

Wolf

[11] Patent Number: 4,738,095

[45] Date of Patent: Apr. 19, 1988

[54] SPINNING OR TWISTING MACHINE DRIVE

[75] Inventor: Horst Wolf, Albershausen, Fed. Rep. of Germany

[73] Assignee: Zinser Textilmaschinen GmbH, Ebersbach/Fils, Fed. Rep. of Germany

[21] Appl. No.: 914,113

[22] Filed: Oct. 1, 1986

[30] Foreign Application Priority Data

Oct. 3, 1985 [DE] Fed. Rep. of Germany ..... 3535385

[51] Int. Cl.[4] ..... D01H 1/32; D01H 1/24; D01H 1/20

[52] U.S. Cl. ..... 57/100; 57/92

[58] Field of Search ..... 57/92, 93, 100, 104, 57/105

[56] References Cited

U.S. PATENT DOCUMENTS

| | | | |
|---|---|---|---|
| 2,689,448 | 9/1954 | Winslow et al. | 57/105 |
| 3,936,998 | 2/1976 | Wolf | 57/92 X |
| 4,161,862 | 7/1979 | Hartmannsgruber et al. | 57/100 X |

*Primary Examiner*—Donald Watkins

*Attorney, Agent, or Firm*—Karl F. Ross; Herbert Dubno

[57] ABSTRACT

The process for operation of a spinning or twisting machine calls for a plurality of working units which are concentrated in groups with at least one motor and tangential belt. The spinning or twisting machine has a different total power need based on different total numbers of working units and/or use of working units with different individual power needs. Independently of the total power need of the spinning or twisting machine, all the motors have the same dimensions. The number of motors are selected so that the sum of the nominal power output of the motors at least approximately corresponds to the total power need of the spinning or twisting machine. Each of the motors are associated with a number of the working units such that the sum of the individual power need of the working units corresponds at least approximately to the nominal power of the motor.

8 Claims, 2 Drawing Sheets

SPINNING OR TWISTING MACHINE DRIVE

CROSS REFERENCE TO RELATED APPLICATION

This application is related to Ser. No. 887,107 filed 10 July 1986 (U.S. Pat. No. 4,685,829); Ser. No. 861,533, filed 9 May 1986 (U.S. Pat. No. 4,699,208); Ser. No. 834,627, filed 27 Feb. 1986 (U.S. Pat. No. 4,691,508); Ser. No. 828,838, filed 12 Feb. 1986 (U.S. Pat. No. 4,679,389); Ser. No. 819,541, filed 16 Jan. 1986 (U.S. Pat. No. 4,694,643); Ser. No. 812,253 filed 23 Dec. 1985 (U.S. Pat. No. 4,612,760); Ser. No. 762,156, filed 2 Aug. 1985 (U.S. Pat. No. 4,612,761); and Ser. No. 721,596 filed 10 Apr. 1985 (U.S. Pat. No. 4,627,228).

FIELD OF THE INVENTION

My present invention relates to a process for setting up or designing the drive for a spinning or twisting machine used to spin or twist roving or fiber into yarn, i.e. a method of matching a drive to the machine and to the drive for such a machine.

BACKGROUND OF THE INVENTION

A spinning or twisting machine can have a plurality of working units which are concentrated in groups with at least one motor and a tangential belt engaging the whorls of the spinning stations. Each spinning or twisting machine has a different total power need based on different total numbers of the working units and/or use of working units with different individual power needs.

Working units are defined here as machine elements with high rotation speed, for example, spindles in spinning or twisting machines or rotors and untangling or separating rollers in open-end-spinning frames.

It is already known that in a machine for making yarn by spinning or twisting, each tangential belt is drivable by an electric motor and the neighboring tangential belts have at least one common guide pulley and these guide pulleys can be coupled with each other so as to be nonrotatable with respect to each other (see German patent application P No. 34 41 230, and the above identified applications).

When a spinning or twisting machine uses working units of a different structural size, for example different dimension spindles or rotors with larger or smaller diameters so that there are a variety of rotation speeds, since variable limits certainly are exceeded, different motors have been used in the past. These motors must then be run in potentially undesirable output ranges or must be fed with potentially undesirable frequencies. Consequently there is incurred an increased expense for mounting, replacement, etc.

OBJECTS OF THE INVENTION

It is an object of my invention to provide an improved process for setting up, designing, or matching a drive for a spinning or twisting machine which will avoid these drawbacks.

It is also an object of our invention to provide an improved process for matching a drive for a spinning or twisting machine with which a reduction of energy consumption as well as a reduction in mounting and replacement expense is achieved in the resulting drive.

SUMMARY OF THE INVENTION

These objects and others which will become more readily apparent hereinafter are attained in accordance with our invention in a process for design of a spinning or twisting machine using a plurality of working units which are concentrated in groups with at least one motor and a tangential belt. The spinning or twisting machine has a different total power need based on different total numbers of the working units and/or use of the working units with different individual power needs.

According to the invention, a method of matching a drive to a spinning machine having a large number n of driven units of substantially equal power demand, comprises the steps of:

driving said units by tangentially containing pulleys thereof by belts;

detaching a number m of said units for which a product of a belt drive efficiency and an efficiency of an electric-motor drive of the respective belt is substantially constant at a maximum; and providing a number p of identical electric motors approximately equal to n/m and all of equal power and coupling each of said p electric motors to the belt of substantially m said units such that a sum of the nominal powers of the p electric motors is at least approximately equal to the total power demand of said machine, all of said motors drive approximately equal numbers of said units, and the sum of the individual power demands of the units driven by each of said motors is at last approximately equal to the nominal power thereof.

Thus, according to my invention independently of the total power need of the spinning or twisting machine all the motors used have the same dimensions, the number of motors being selected so that the sum of the nominal power output of the motors at least approximately corresponds to the total power need of the spinning or twisting machine and each of the motors is associated with a number of the working units such that the sum of the individual power need of the working units corresponds at least approximately to the nominal power of the motor.

Our invention has the advantage that the construction of the machine and the attachments for the motors (switch devices, mounting devices, covers, etc) need not be developed for different size motors. The motors of the same structural size can be mass produced or purchased at a reduced expense in comparison to an assembly of different motors.

The required supply of replacement motors is limited to a single structural size and thus is reduced. Regarding replacement needs using one structural size for the motors eliminates any possible motor selection error in replacement. Since one motor drives a fixed number of working units, an increased energy saving is attained.

For the presently named working units to which the present invention relates and whose operating power needs amount to between about 15 watts and about 50 watts it has been shown that the efficiency is optimum with a motor size of about 2.2 kW to about 4.5 kW. Since the investment cost is reduced requiring fewer motors, it is particularly advantageous to select motors with a nominal operating power output in the upper third of this range.

Advantageously, in particular embodiments of our invention the motor power delivered equals from 2.2 kW to 4.5 kW with an efficiency of motor and drive system each between 0.8 and 0.87.

In another embodiment of my invention with an additional device operated by another one of the motors, the additional device is driven by a motor of the same dimensions as the motors driving the working units. Further, advantageously the additional device is the drafting frame of the machine.

Advantageously, independently of the total power needs of the spinning or twisting machine, different structural forms and/or different ones of the individual power needs of the working units of different dimensions, only motors of a single size are used. The motors are provided in such number that the sum of the output power of the motors corresponds to the total power need of the spinning or the twisting machine. Further each of the motors drives an approximately equal number of the working units (field size) whose sum total power requirement corresponds to the power delivered by the motor.

BRIEF DESCRIPTION OF THE DRAWING

The above and other objects, features and advantages of my invention will become more readily apparent from the following description, reference being made to the accompanying drawing in which.

SPECIFIC DESCRIPTION

Figure 1:
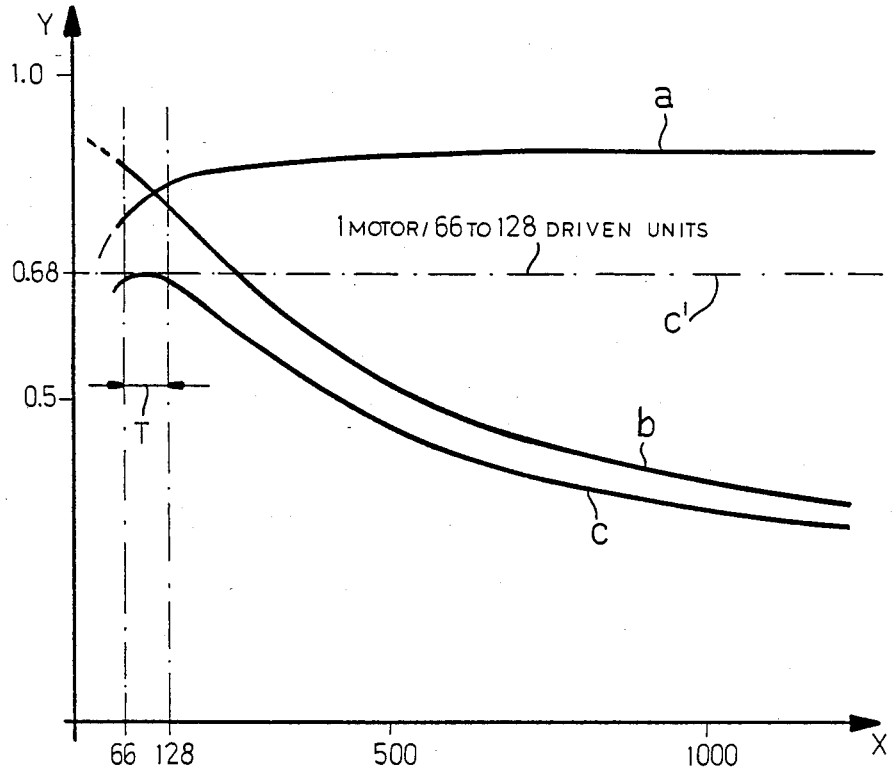
FIG. 1 is a graph used to ascertain the motor with the optimum power output and illustrating the principles of the invention.

FIG. 1 shows a graph drawn up based on the teachings of the invention in which the number of working units of the spinning or twisting machine are given on the X-axis, while the efficiency is given along the Y-axis. It is understood that the motor power and energy output increases along the X-axis with an increasing number of working units.

The curve a shows the efficiency of an individual motor of that motor strength which is necessary for the designated number of working units. This efficiency is approximately constant over a wide power range but falls off quickly at low power output.

The curve b refers to an efficiency of a drive system, particularly a tangential belt drive with an increasing belt cross section which is necessary for the designated number of working units. This efficiency decreases with an increasing number of working units.

The curve c shows the total efficiency of the drive motor and drive system. It is apparent that the optimum total efficiency lies in the region T indicated on FIG. 1. This results when the product of both efficiencies are maximum. The region T of the optimum total efficiency determines the smallest and largest number of working units which should be driven by a motor. Region T also delineates output power of these motors from the individual power needs of the working unit. In practice, therefore, m=66–128 and preferably about 100. Thus, for a machine with 1000 spindles, preferably 10 motors will be used each driving 100 spindles. This corresponds to c' representing the efficiency vs. number of spindles for the machine of the invention.

Since simultaneously a larger motor strength leads to fewer motors and thus to reduced costs as well as to reduced energy consumption by less idling along the drive belt, it is appropriate to go to the upper limit of the region T and to select both the motor corresponding to this limit and also the corresponding number of working units.

In a ring spinning machine with a tangential belt drive system and working units in the form of spinning spindles, the motor power required at the lower limit of the region T is 2.2 kW for a 66 spindle system. At the upper limit of the region T, the motor power required is 4.4 kW for a 128 spindle system. The total efficiency amounts to about 0.68.

By graphical representation of the motor efficiency with increasing motor strength and the efficiency of the belt drive operating system with increasing belt cross section, sometimes with the number of working units, there can be ascertained the efficiency of the combined, drive motor and drive system. Thereby a total efficiency is derivable from which the motors with the optimum motor performance are determined.

It has also surprisingly been shown that in a case where the working units have a different power need, the relative position of the efficiency curve a,b and thus also curve c in FIG. 1 are not essentially changed. Rather in this other case only the scale of the X-axis is changed. That means that the optimum motor power in the case of this other system of working units having different power needs is also 4.5 kW, however a larger or smaller number of working units than the approximately 128 units of the above example should be driven.

Figure 2:
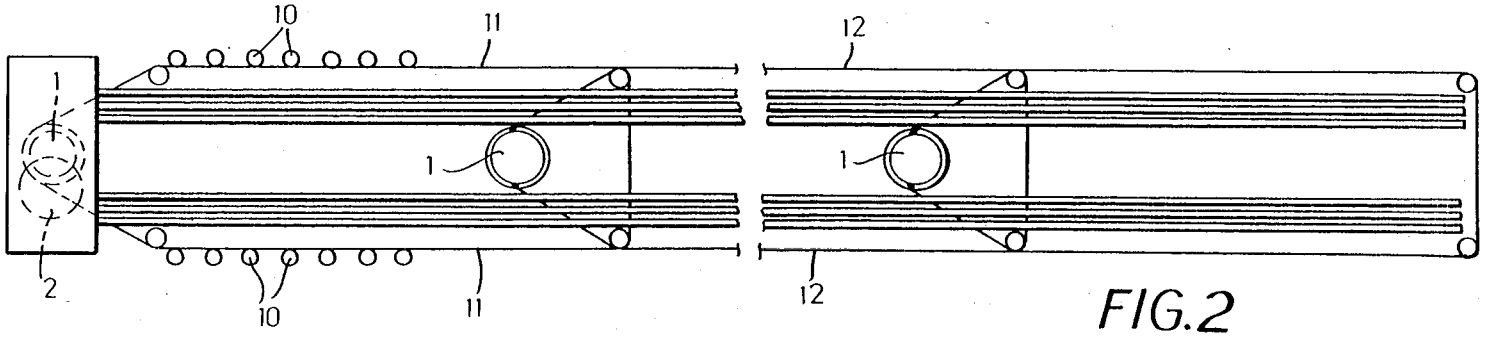
FIG. 2 is a partially cutaway top plan view of a spinning machine for making yarn.
Figure 3:
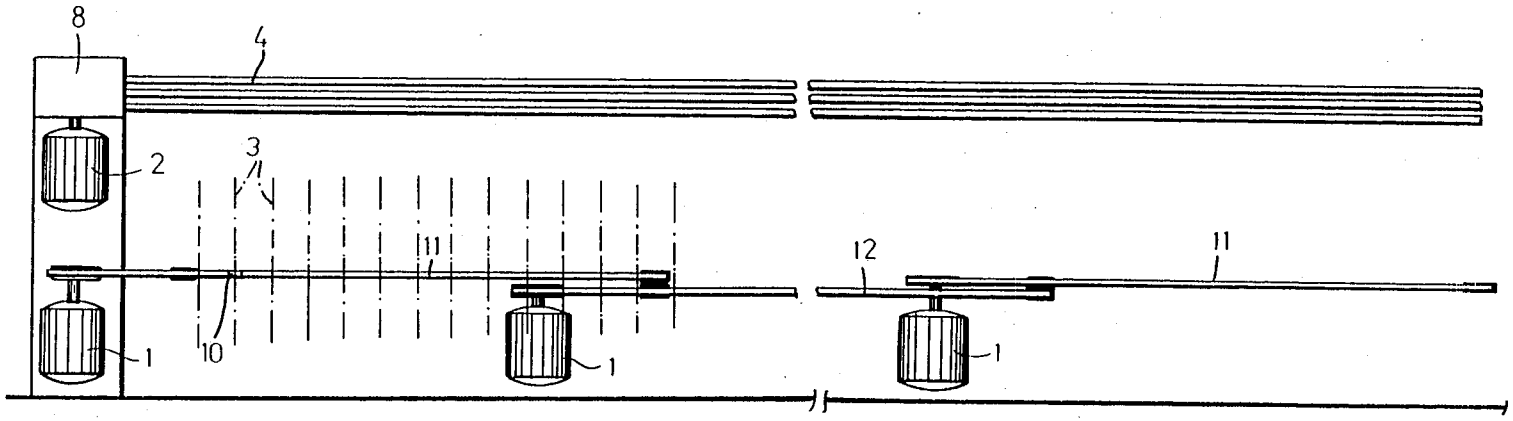
FIG. 3 is a partially cutaway front elevational view of the spinning machine shown in FIG. 1.

In FIGS. 2 and 3 a spinning machine is shown in which it is apparent that motors 1 of similar dimensions are used to drive the working units comprising spindles 3 driven by tangential belts 11 and/or 12 engaged with whorls 10 of spindles 3. These motors 1 have suitably a nominal power requirement of 4.5 kW.

The spindles 3, that is, the working units of the machine, have an operating power requirement of 15 watt to 35 watt according to their inertia or weight, diameter and rotation speed. This power requirement, that is, the power received by the spindle, is not constant but must increase as the spindle is filled. Since the electric motors are overloadable in a known time and at a certain quantitative limit, at least an approximate equality exists between the sum of the delivered and consumed power and a mean power required can be assumed.

As also can be seen from FIGS. 2 and 3, motors 1 are usable which drive working units in a definite number (field size). It is also possible to drive other working units, for example a drafting roll frame 4 with a motor 2 of the same dimensions as the motors 1. This motor 2 is coupled to a drafting-frame drive 8 which is shown schematically in FIG. 3.

In order to drive the working units, that is, the spindles 3, at the desired spindle rotational speed by the motors 1, it is necessary with motors, which are not adjustable as to their rotation speed, to be able to select different drive disks on the motor shaft not shown in detail. Thus gearing selecting the desired spindle rotation speed is provided.

With motors which are changeable in their rotation speed for example by changing the power supply frequency the choice of the suitable drive pulley is conditioned so that the motor at its maximum rotation speed can run the spindles at their operating speed so that it provides the nominal power output. Otherwise the choice of the drive pulley is without significance for the field size since only the power output has to be allowed for.

Since the motors 1 have been structured similarly to drive the spindles 3, the groups of working units driven by the motors should also be equal sized. Of course, allowance can be made for small variations in these structures.

The structural size of the spindles used in a particular machine is fixed by the design of this machine and remains unchanged. The rotation speed with which these working units are driven can change according to spinning technology considerations.

The number of working units in each group (field size) must be oriented to the highest output power required by the working units at the highest provided rotation speed.

Thus this results in three or four motors 1 and/or 2 of the same dimension being used independently of different power requirements, different dimensions and different numbers of working units. Regarding the motor 1 and the field size, that is, the number of spindles driven by the motor, the number of working units associated with a motor 1 should be chosen so that the sum of the power received by the working unit corresponds to the power delivered to the motor 1. Here, between 75 to 150 working positions per field are particularly advantageous.

I claim:

1. A drive for a spinning or twisting machine with a plurality of working units which are concentrated in groups with at least one motor and tangential belt, said spinning or twisting machine having a different total power need based on different total numbers of said working units and/or said working units having different individual power needs, the improvement wherein independently of said total power need of said spinning or said twisting machine, with different structural forms and/or of different ones of said individual power needs of said working units of different dimensions, only motors having the same power and dimensions are coupled to said groups so that to provide said total power need of said spinning or twisting machine said motors are provided in such number that the sum of said output power of said motors corresponds to said total power need of said spinning or said twisting machine and each of said motors drives an approximately equal number of said working units whose sum total power requirement corresponds to the power delivered by said motor.

2. The improvement according to claim 1 wherein said motors have powers of 2.2 kW to 4.5 kW with an efficiency of the motor and an associated drive system of the working units between 0.8 and 0.87.

3. The improvement defined in claim 2 wherein an additional device which is a dafting frame is driven by another one of said motors, the improvement wherein said other one of said motors has the same dimensions as said motors driving said working units.

4. A method of matching a drive to a spinning machine having a large number n of driven units of substantially equal power demand, comprising the steps of:

driving said units by tangentially containing pulleys thereof by belts;

detaching a number m of said units for which a product of a belt drive efficiency and an efficiency of an electric motor drive of the respective belt is substantially constant at a maximum; and providing a number p of identically dimensioned electric motors approximately equal to n/m and all of equal power and coupling each of said p electric motors to the belt of substantially m said units such that a sum of the nominal powers of the p electric motors is at least approximately equal to the total power demand of said machine, all of said motors drive approximately equal numbers of said units, and the sum of the individual power demands of the units driven by each of said motors is at least approximately equal to the nominal power thereof.

5. The method defined in claim 4 wherein each of said motors has a nominal power output of 2.2 kW to 4.5 kW.

6. The method defined in claim 5 wherein substantially 66 to 128 units are driven by each of said motors.

7. The method defined in claim 6 wherein the units have individual power demands between substantially 15 watts and 50 watts.

8. A method of operating a spinning or twising machine having a plurality of working units, said machine having a differnt total power need based on different total numbers of said working units and/or said working units having different individual power needs, comprising the steps of:

concentrating said plurality of working units into groups, each group having at least one motor and a tangential belt;

providing said spinning or twisting machine, independent of said total power need with motors all of which have the same dimensions;

selecting said motors in such number so that the sum of a nominal power output of said motors corresponds at least approximately to said total power requirement of said spinning or twisting machine; and associating each of said motors with a number of said working units such that the sum of said individual power needs of said working units corresponds at least approximately to said nominal power output of said motors.

* * * * *